US008758873B2

(12) United States Patent
Kleber et al.

(10) Patent No.: US 8,758,873 B2
(45) Date of Patent: Jun. 24, 2014

(54) CAST-IN-PLACE TORSION JOINT

(75) Inventors: Richard M. Kleber, Clarkston, MI (US); Michael D. Hanna, West Bloomfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 216 days.

(21) Appl. No.: 13/232,013

(22) Filed: Sep. 14, 2011

(65) Prior Publication Data

US 2012/0003417 A1 Jan. 5, 2012

Related U.S. Application Data

(62) Division of application No. 11/848,732, filed on Aug. 31, 2007, now Pat. No. 8,020,300.

(51) Int. Cl.
*B32B 3/02* (2006.01)
*B21D 53/26* (2006.01)

(52) U.S. Cl.
USPC ..... 428/66.1; 29/894

(58) Field of Classification Search
USPC ..... 29/428, 894, 894.011, 894.36, 361, 29/888, 72, 892, 892.1, 892.11, 458, 527, 29/2, 3, 530; 474/168, 66.1, 66.6; 301/105.1; 248/562, 185; 188/218 XL, 188/218 R, 18 A
See application file for complete search history.

(56) References Cited

U.S. PATENT DOCUMENTS

2007/0142149 A1* 6/2007 Kleber ..... 474/168

* cited by examiner

*Primary Examiner* — John C Hong
(74) *Attorney, Agent, or Firm* — BrooksGroup

(57) ABSTRACT

One embodiment of the invention includes a product including an annular portion including a frictional surface and a first flange portion extending from the frictional surface, wherein the first flange portion comprises a first face, a second face, and a third face; and a hub portion and a second flange portion extending from the hub portion, wherein the second flange portion engages the first face, the second face, and the third face of the first flange portion.

10 Claims, 7 Drawing Sheets

CAST-IN-PLACE TORSION JOINT

CROSS-REFERENCE TO RELATED APPLICATIONS

This application is a divisional of U.S. application Ser. No. 11/848,732 filed Aug. 31, 2007.

TECHNICAL FIELD

The field to which the disclosure generally relates includes a product with an improved cast-in-place torsion joint and a method for producing the same.

BACKGROUND

A variety of parts such as rotors, pulleys, brake drums, transmission gears, and other parts are typically composed of single piece cast iron or steel to support heavy loads and to resist wear.

SUMMARY OF EXEMPLARY EMBODIMENTS OF THE INVENTION

One embodiment of the invention includes a product including an annular portion including a frictional surface and a first flange portion extending from the frictional surface, wherein the first flange portion comprises a first face, a second face, and a third face; and a hub portion and a second flange portion extending from the hub portion, wherein the second flange portion engages the first face, the second face, and the third face of the first flange portion.

Other exemplary embodiments of the invention will become apparent from the detailed description of exemplary embodiments provided hereinafter. It should be understood that the detailed description and specific examples, while indicating the exemplary embodiments of the invention, are intended for purposes of illustration only and are not intended to limit the scope of the claimed invention.

BRIEF DESCRIPTION OF THE DRAWINGS

Exemplary embodiments of the invention will become more fully understood from the detailed description and the accompanying drawings.

DETAILED DESCRIPTION OF EXEMPLARY EMBODIMENTS

The following description of the embodiment(s) is merely exemplary in nature and is in no way intended to limit the invention, its application, or uses.

Figure 1A:
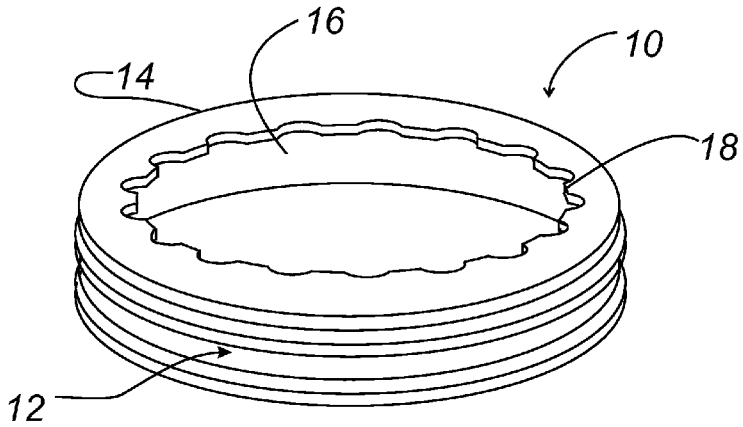
FIG. 1A is a perspective view of a brake drum according to one embodiment of the invention.

FIG. 1A shows a perspective view of a product 10. The product 10 may be for example, but is not limited to, a transmission gear, a transmission gear assembly, a rotor, a_pulley, or a sprocket. In one embodiment of the invention, the product 10 may be a brake drum 10 including an annular portion 12. The annular portion 12 may include a first flange portion (annular flange portion) 14 and a frictional surface 16, where the first flange portion 14 extends from the frictional surface 16. In one embodiment, the frictional surface 16 may be located on the internal surface of the annular portion 12, and brake friction pads (not shown) may push outward on the frictional surface 16 to stop the motion of an automobile or to prevent a stopped automobile from moving. The first flange portion 14 may comprise a plurality of teeth 18 which may assist in preventing damage to the product 10 when torque is applied thereto. In another embodiment, the first flange portion 12 may include through holes (not shown) and the through holes may be located in at least one of the plurality of teeth 18. In the embodiment where the first flange portion 12 includes through holes, the first flange portion 14 may or may not include the plurality of teeth 18.

Figure 1B:
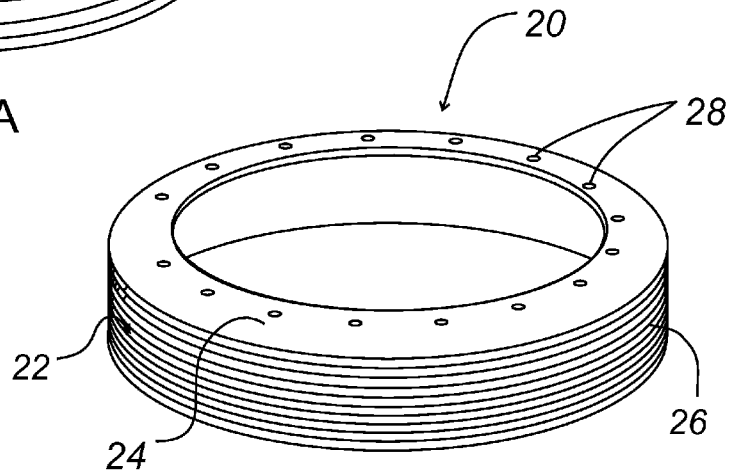
FIG. 1B is a perspective view of a pulley according to one embodiment of the invention.

In another embodiment, the product 10 may include a pulley 20. FIG. 1B shows a perspective view of a pulley 20 according to one embodiment of the invention. The pulley 20 includes an annular portion 22. The annular portion 22 includes a frictional surface 26 and a first flange portion 24, where the first flange portion 24 extends from the frictional surface 26. In one embodiment, the frictional surface 26 may be ribbed. The frictional surface 26 may be adapted for engagement by a device such as a belt (not shown). In one embodiment, the frictional surface 26 may be engaged by a belt of any known type, for example a belt having a generally rectangular cross-section or a belt having a v-shaped or triangular cross-section. A belt having a v-shaped cross section may be implemented with a notched frictional surface (not shown). In another embodiment, the pulley 20 may include through holes 28 in the first flange portion 24. In another embodiment, the first flange portion 24 may include a plurality of teeth (not shown) but no through holes 28, as shown in U.S. patent application Ser. No. 11/440,919, which is assigned to the assignee of this application. In another embodiment, the first flange portion 24 may include a plurality of teeth (not shown) and the through holes 28 may be located in at least one of the plurality of teeth.

Figure 1C:
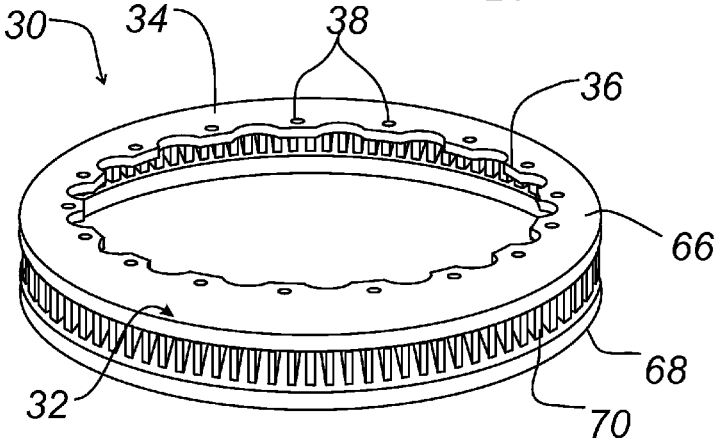
FIG. 1C is a perspective view of a rotor according to one embodiment of the invention.

In another embodiment, the product 10 may include a vehicle disk brake rotor 30. FIG. 1C shows a perspective view of a rotor 30 according to one embodiment of the invention. The rotor 30 includes an annular portion 32. The annular portion 32 includes a first portion which may include at least one of a first face 66 and a second face 68, and a first flange portion 34 extending from the first portion. The faces 66 and 68 may be adapted for engagement by a brake pad (not shown). The first flange portion 34 may extend from the first face 66. While the rotor 30 shown is vented, in other embodiments, the rotor 30 may be un-vented. In one embodiment where the rotor 30 is vented, the first face 66 and the second face 68 may be separated by a plurality of vanes 70. In one embodiment, first flange portion 34 may include a plurality of teeth 36. In another embodiment, the first flange portion 34 may include through holes 38 and the through holes 38 may be located in at least one of the plurality of teeth 36. In another embodiment, the first flange portion 34 may include the through holes 38 but not include the plurality of teeth 36. In another embodiment, the first flange portion 34 may include a plurality of teeth (not shown) but no through holes 38, as shown in U.S. patent application Ser. No. 11/220,893, which is assigned to the assignee of this application. In another embodiment, the first flange portion 34 may include the plurality of teeth 36 but not the through holes 38.

Figure 2A:
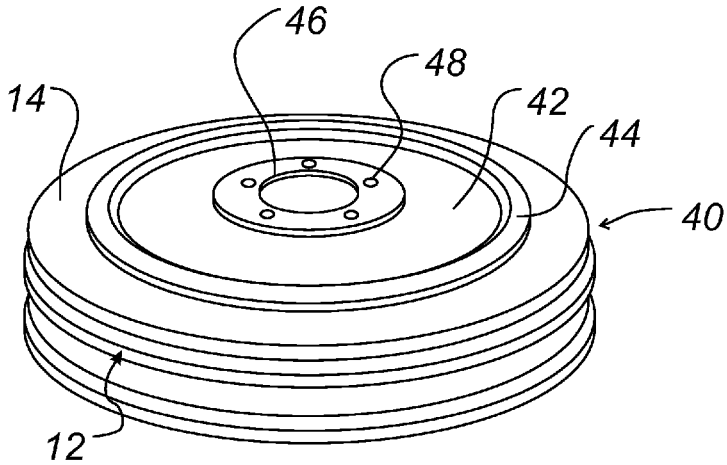
FIG. 2A is a perspective view of a brake drum assembly according to one embodiment of the invention.

In another embodiment, the automobile component 10 includes a brake drum assembly 40 shown in FIG. 2A. The brake drum assembly 40 includes the annular portion 12, the first flange portion 14 extending from the annular portion 12, a hub portion 42, and a second flange portion (hub flange portion) 44 extending from the hub portion 42. The second flange portion 44 may be constructed and arranged to engage the first flange portion 14 and thereby prevent rotation of the hub portion 42 relative to the annular portion 12. In an embodiment where the first flange portion 14 includes a plurality of teeth 18 (shown in FIG. 1A), the second flange portion 44 may also include a plurality of hub teeth (not shown) adapted to engage the complementary teeth 18. The annular portion 12 may comprise a first material. The hub portion 42 and the second flange portion 44 may comprise a second material that is lighter by volume (i.e., less dense) than the first material. The first material may comprise one of cast iron or steel. In one embodiment the second material may comprise one of aluminum, magnesium, plastic, or composite material. Aluminum may have a density of 2,700 kg/m$^3$ and magnesium may have a density of 1,738 kg/m$^3$, which are significantly lighter by volume than, for example, iron having a density of 7874 kg/m$^3$. Therefore, in one embodiment, the overall weight of the drum assembly 40 is less than that of a comparable drum assembly composed entirely of cast iron or steel. In another embodiment, the hub portion 42 may also include features to attach to a vehicle axle assembly, for example a center opening 46 and a bolt hole pattern 48. In another embodiment the first material and second material are substantially the same.

Figure 2B:
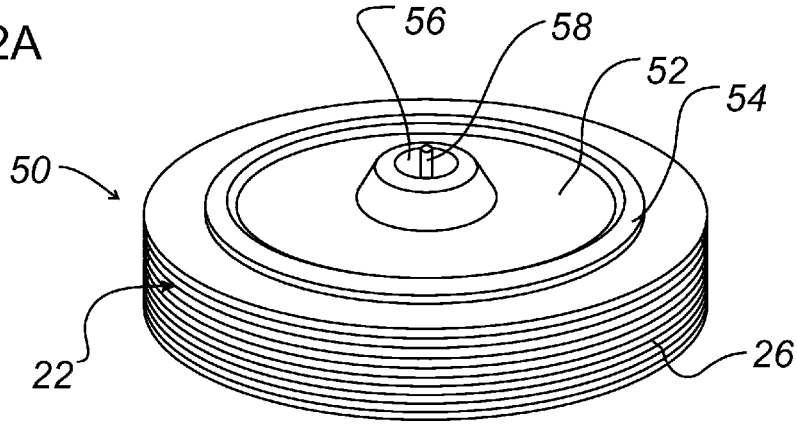
FIG. 2B is a perspective view of a pulley assembly according to one embodiment of the invention.

In another embodiment, the product 10 includes a pulley assembly 50 shown in FIG. 2B. The pulley assembly 50 includes the annular portion 22, the first flange portion 24 (shown in FIG. 1B) extending from the annular portion 22, a hub portion 52, and a second flange portion 54 extending from the hub portion 52. The second flange portion 54 may be constructed and arranged to engage the first flange portion 24 (shown in FIG. 1B) and thereby prevent rotation of the hub portion 52 relative to the annular portion 22. The through holes 28 in the first flange portion 24 (shown in FIG. 1B) may interface with the second flange portion 54 to receive a connecting post or interlocking portion or spline as described hereafter. In an embodiment where the first flange portion 24 includes a plurality of teeth (not shown), the second flange portion 54 may also include a plurality of hub teeth (not shown) adapted to engage the complementary teeth on the first flange portion 24. The annular portion 22 may comprise the first material, as described above. The pulley assembly 50 may transfer rotational energy from one device to another. An energy transfer device such as a belt engaged with the pulley assembly 50 tends to wear the friction surface over time, and therefore the first material should provide good resistance to wear and be relatively inexpensive. The hub portion 52 and the second flange portion 54 may comprise the second material, as described above. In one embodiment, the overall weight of the pulley assembly 50 is less than that of a comparable pulley assembly composed entirely of cast iron or steel. In another embodiment, the hub portion 52 may also include features to facilitate the attachment of the pulley assembly to an accessory drive component such as a shaft. These features may include, for example, a central aperture 56 and a locking element 58. The central aperture 56 may be a cylindrical or conical bored hole. The locking element 58 may be a keyhole. The features such as the central aperture 56 and the locking element 58 may be machined after the casting process.

Figure 2C:
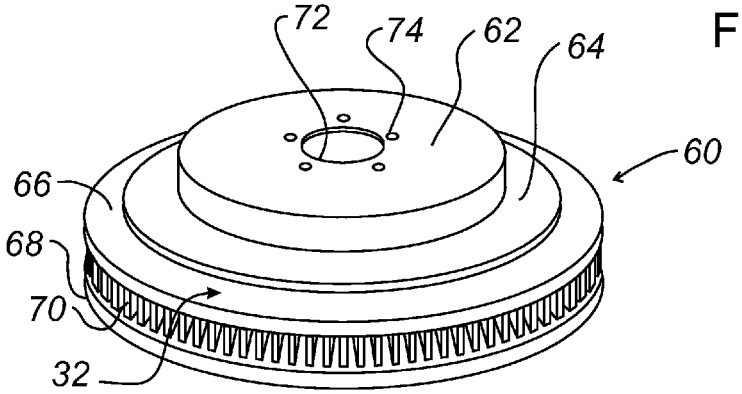
FIG. 2C is a perspective view of a rotor assembly according to one embodiment of the invention.

In another embodiment, the product 10 includes a rotor assembly 60 shown in FIG. 2C. The rotor assembly 60 includes the annular portion 32, the first flange portion 34 (shown in FIG. 1C) extending from the annular portion 32, a hub portion 62, and a second flange portion 64 extending from the hub portion 62. The second flange portion 64 may be constructed and arranged to engage the first flange portion 34 and thereby to prevent rotation of the hub portion 62 relative to the annular portion 32. In an embodiment where the first flange portion 34 includes a plurality of teeth 36 (shown in FIG. 1C), the second flange portion 64 may also include a plurality of hub teeth (not shown) adapted to engage the complementary teeth 36. The annular portion 32 may comprise the first material, as described above. The hub portion 62 may comprise the second material, as described above. The first material may provide good resistance to thermal deformation, resist wear during engagement of the brake pad (not shown) with the frictional surfaces 66 and 68, which generates heat, and be relatively inexpensive. In one embodiment, the overall weight of the rotor assembly 60 is less than that of a comparable rotor assembly composed entirely of cast iron or steel. In another embodiment, the hub portion 62 may also include features to attach the rotor assembly 60 to a vehicle axle assembly, for example a central aperture 72 and a plurality of bolt holes 74.

Figure 3A:
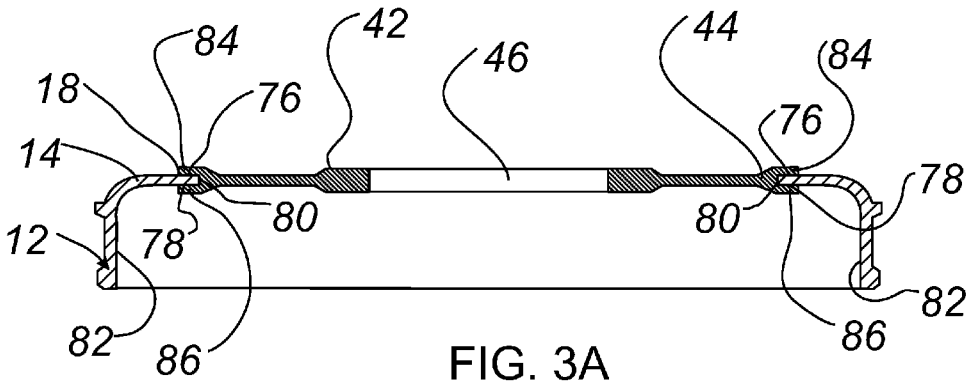
FIG. 3A is a partial sectional view of the brake drum assembly of FIG. 2A according to one embodiment of the invention.

Referring to FIG. 3A, a partial sectional view of the brake drum assembly 40 is shown. The second flange portion 44 is constructed and arranged to engage the first flange portion 14. The first flange portion 14 may extend from a friction surface 82. The first flange portion 14 may include a first face 76, a second face 78, and a third face 80. In one embodiment, the second flange portion 44 engages the first face 76, the second face 78, and the third face 80 of the first flange portion 14. The second flange portion 44 may include an outer second flange portion 84 and an inner second flange portion 86. The outer second flange portion 84 may engage the first face 76 and the inner second flange portion 86 may engage the second face 78. In one embodiment, the engagement of the second flange portion 44 with the first flange portion 14 may be described as the first flange 14 being trapped between the outer second flange portion 84 and the inner second flange portion 86. However, according to an alternate embodiment of the present invention (not shown), the geometry of the first flange portion 14 may be replaced with that of second flange portion 44 and vice versa. In other words, the first flange portion 14 may include opposing portions (not shown) configured to trap the second flange portion 44 therebetween.

Figure 3B:
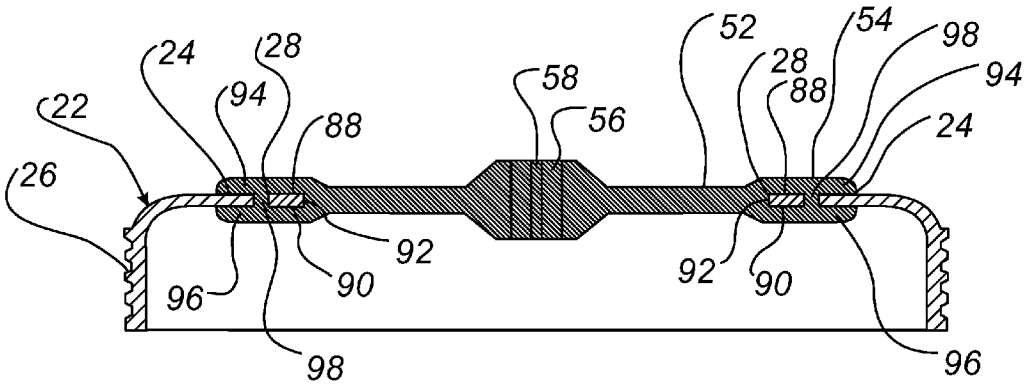
FIG. 3B is a partial sectional view of the pulley assembly of FIG. 2B according to one embodiment of the invention.
Figure 3C:
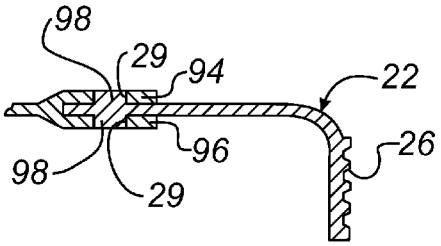
FIG. 3C is a partial sectional view of the pulley assembly of FIG. 2B according to one embodiment of the invention.
Figure 3D:
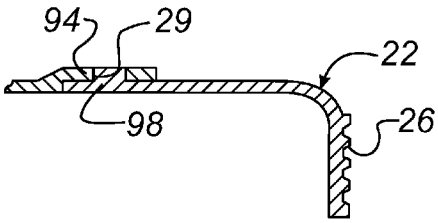
FIG. 3D is a partial sectional view of the pulley assembly of FIG. 2B according to one embodiment of the invention.

Referring to FIG. 3B, a partial sectional view of the pulley assembly 50 is shown, according to one embodiment of the invention. The hub 52 may include the central aperture 56 and the locking element 58. The second flange portion 54 is constructed and arranged to engage the first flange portion 22. The first flange portion 22 may include a first face 88, a second face 90, and a third face 92. In one embodiment, the second flange portion 54 engages the first face 88, the second face 90, and the third face 92 of the first flange portion 22. The second flange portion 54 may include an outer second flange portion 94 and an inner second flange portion 96. The outer second flange portion 94 may engage the first face 88 and the inner second flange portion 96 may engage the second face 90. In one embodiment, the second flange portion 54 also fills the through holes 28 to form connectors or connection posts (splines) 98 extending between the outer second flange portion 94 and the inner second flange portion 96. In one embodiment, the connectors 98 may provide a mechanical interface between the hub portion 52 and the annular portion 22 that is capable of transmitting the torque required in the operation of the accessory drive system. In another embodiment, the connectors 98 may be metallurgically bonded to the annular portion 22. In an alternative embodiments shown in FIGS. 3C and 3D, the connectors 98 may extend from the first face 88 or the second face 90 of the flange portion 24 into a through-hole 29 formed in at least one of the outer second flange portion 94 or the inner second flange portion 96.

Another embodiment does not include the through holes 28 and so there are no connectors 98, as shown in U.S. patent application Ser. No. 11/440,919, which is assigned to the assignee of this application. In one embodiment, the engagement of the second flange portion 54 with the first flange portion 22 may be described as the first flange portion 22 being trapped between the outer second flange portion 94 and the inner second flange portion 96. However, according to an alternate embodiment of the present invention (not shown), the geometry of the first flange portion 22 may be replaced with that of second flange portion 54 and vice versa. In other words, the first flange portion 22 may include opposing portions (not shown) configured to trap the second flange portion 54 therebetween.

Figure 3E:
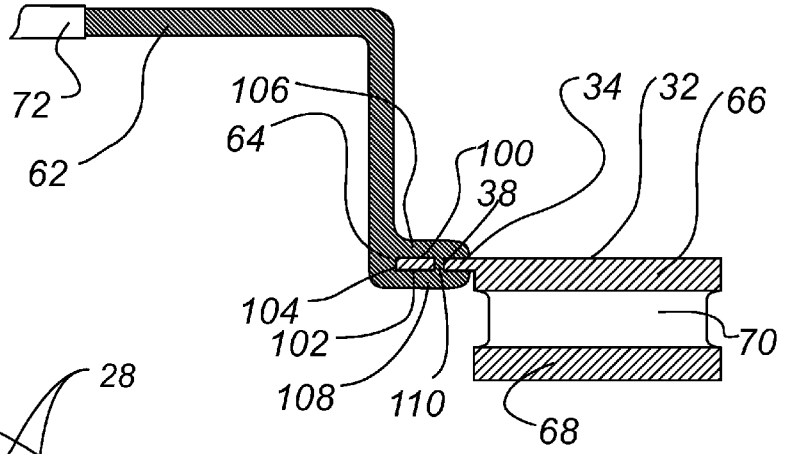
FIG. 3E is a partial sectional view of the rotor assembly of FIG. 2C according to one embodiment of the invention.

Referring now to FIG. 3E, a partial sectional view of the rotor assembly 60 is shown, according to one embodiment of the invention. The second flange portion 64 is constructed and arranged to engage the first flange portion 34. The first flange portion 34 may include a first face 100, a second face 102, and a third face 104. In one embodiment, the second flange portion 64 engages the first face 100, the second face 102, and the third face 104 of the first flange portion 34. The second flange portion 64 may include an outer second flange portion 106 and an inner second flange portion 108. The outer second flange portion 106 may engage the first face 100 and the inner second flange portion 108 may engage the second face 102. The second flange portion 64 also fills the through holes 38 to form connectors 110 between the outer second flange portion 106 and the inner second flange portion 108. The connectors 110 may provide a mechanical interface between the hub portion 62 and the annular portion 32 that is capable of transmitting the torque required. Another embodiment does not include the through holes 38 and so there are no connectors 110, as shown in U.S. patent application Ser. No. 11/220,893, which is assigned to the assignee of this application. In one embodiment, the engagement of the second flange portion 64 with the first flange portion 34 may be described as the first flange portion 34 being trapped between the outer second flange portion 106 and the inner second flange portion 108. However, according to an alternate embodiment of the present invention (not shown), the geometry of the first flange portion 34 may be replaced with that of second flange portion 64 and vice versa. In other words, the first flange portion 34 may include opposing portions (not shown) configured to trap the second flange portion 64 therebetween.

Figure 4A:
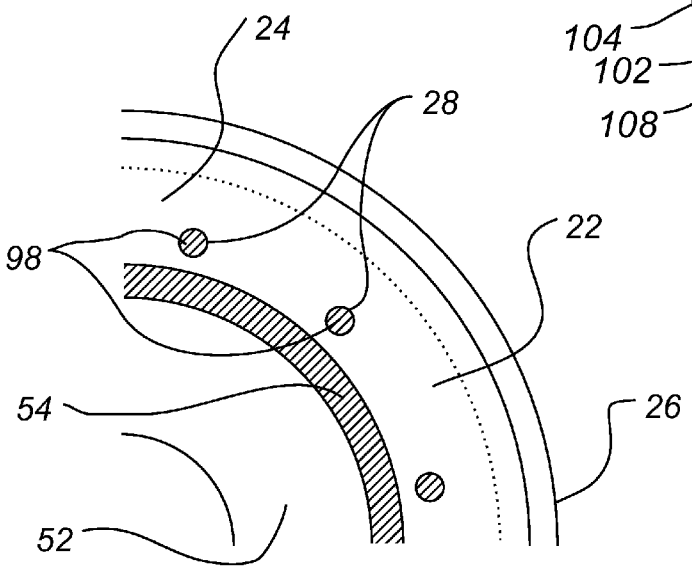
FIG. 4A is a partial sectional view of the interface of the annular portion of the pulley and the hub portion of the pulley.
Figure 4B:
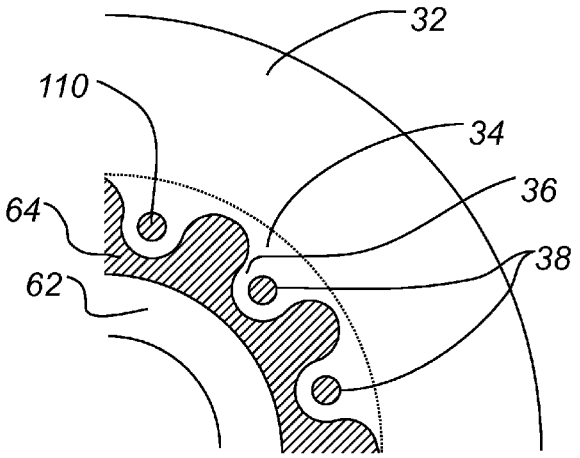
FIG. 4B is a partial sectional view of the interface of the annular portion of the rotor and the hub portion of the rotor.

Referring now to FIG. 4A, a detailed partial sectional view of the interface of the annular portion 22 of the pulley assembly 50 and the hub portion 52 of the pulley assembly 50 is provided according to one embodiment of the invention. According to another embodiment of the invention, FIG. 4B shows a detailed partial sectional view of the interface of the annular portion 32 of the rotor assembly 60 and the hub portion 62 of the rotor assembly.

Figure 5A:
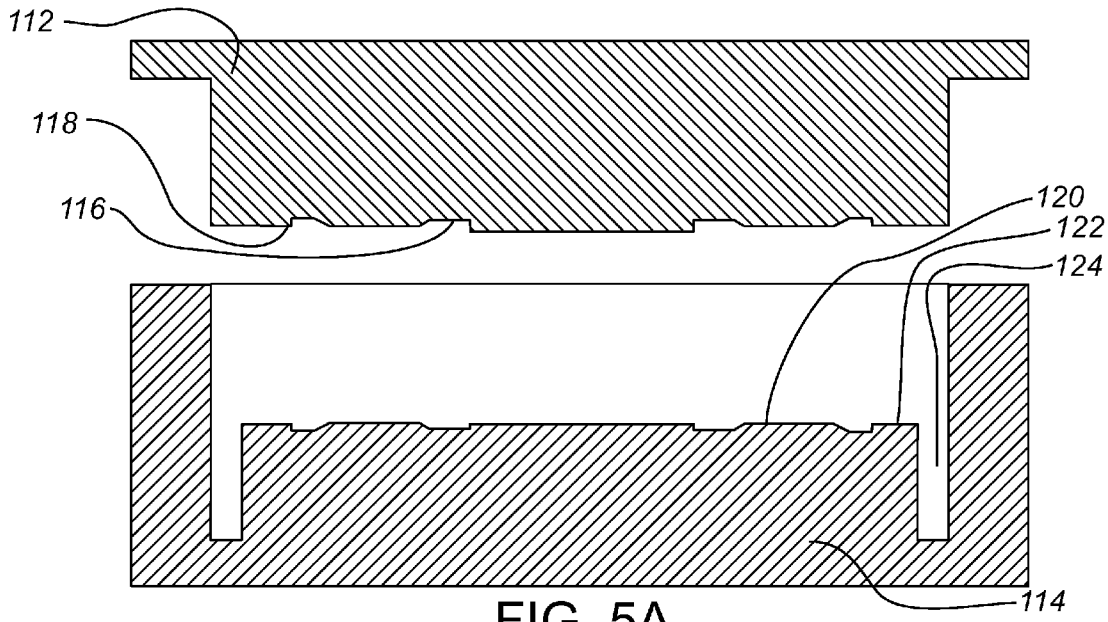
FIG. 5A illustrates a method of making the brake drum assembly of FIG. 2A according to one embodiment of the invention.

Referring now to FIG. 5A, a method of producing the brake drum assembly 40 is shown according to one embodiment of the invention. A first tool 112 and a second tool 114 are configured to manufacture the brake drum assembly 40 and are shown in an open position. The first tool 112 includes a first tool surface 116 and a first sealing lip 118. The first tool surface 116 may define the outer surfaces of the hub portion 42. The first sealing lip 118 may define the edges of the outer second flange portion 84. The second tool 114 includes a second tool surface 120, a second sealing lip 122, and an annular portion cavity 124. The second tool surface 120 may define the inner surfaces of the hub portion 42. The second sealing lip 122 may define the edges of the inner second flange portion 86. The annular portion cavity 124 may be of a size and shape to readily accept the insertion of the annular portion 12. The first tool 112 and the second tool 114 may be metallic.

Figure 5B:
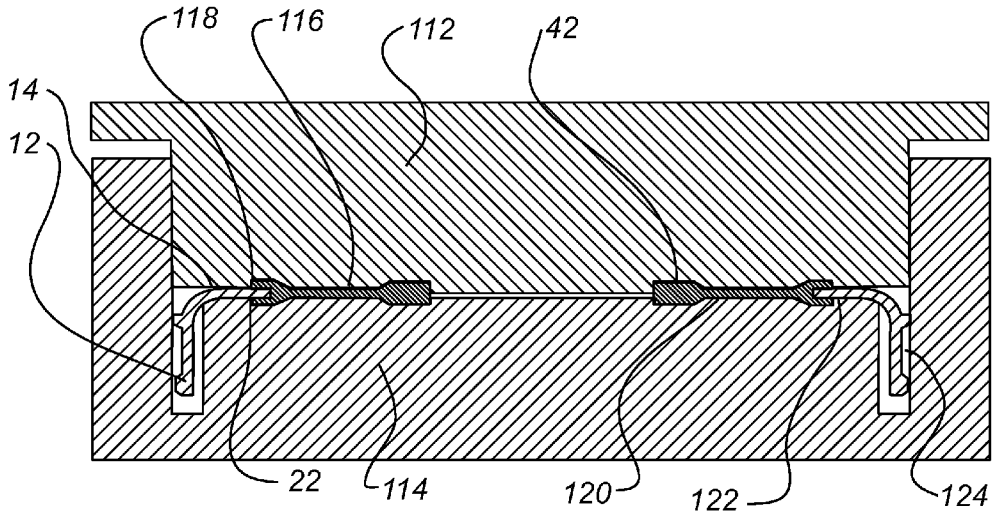
FIG. 5B illustrates a method of making the brake drum assembly of FIG. 2A according to one embodiment of the invention.

As shown in FIG. 5B, the annular portion 12 is placed in the annular portion cavity 124. The first tool 112 is then placed over the second tool 114. A compressive force is applied to the first tool 112 and the second tool 114, which in turn applies a compressive force clamping the first flange portion 14 between the first sealing lip 118 and the second sealing lip 122. The sealing lips 118 and 122 may define the perimeter of a central cavity 116 that is formed between the first tool 112 and the second tool 114. A material is then introduced into the central cavity 116 to form the hub portion 42 and the second flange portion 54 extending from the hub portion 42. The material may be a molten substance, for example molten aluminum or magnesium. The material is transferred into the central cavity 116, for example injected into the cavity 116. In another embodiment, the material is a semi-solid material and may be introduced into the central cavity 116 in accordance with the well known semi-solid forging process. The sealing lips 118 and 122 may prevent the material from leaking out of the central cavity 116. The material forms the hub portion 42, as shown in FIG. 5B. In one embodiment, the molten material forms hub teeth (not shown) which mechanically interlock with the teeth 18. In one embodiment, as the molten material comes into contact with the annular portion 12, a welding or diffusion bonding process may occur at the interface between the hub portion 42 and the annular portion 12 to further prevent relative motion therebetween. In one embodiment, the first tool 112, the second tool 114, and the annular portion 12 are maintained at a predetermined elevated temperature before the material is transferred into the central cavity 116, such that the material does not prematurely cool upon contact with a relatively cold surface. After the passing of a sufficient cooling time, the tools 112 and 114 would return to the open position as shown in FIG. 5A and the brake drum assembly 40 would be removed for further processing. Further processing may include, for example, machining features into the hub portion 42 such as the center opening 46 or the bolt hole pattern 48 shown in FIG. 2A. When the tools 112 and 114 are returned to the open position, the next annular portion 12 would be inserted into the open tooling and the manufacturing process of the brake drum assembly 40 would repeat.

In another embodiment (not shown), the hub portion 42 may be positioned in the first tool 112, the second tool 114 may be placed over the first tool 112, and a material may be introduced into a cavity formed between the tools 112 and 114 to form the annular portion 12.

Figure 6A:
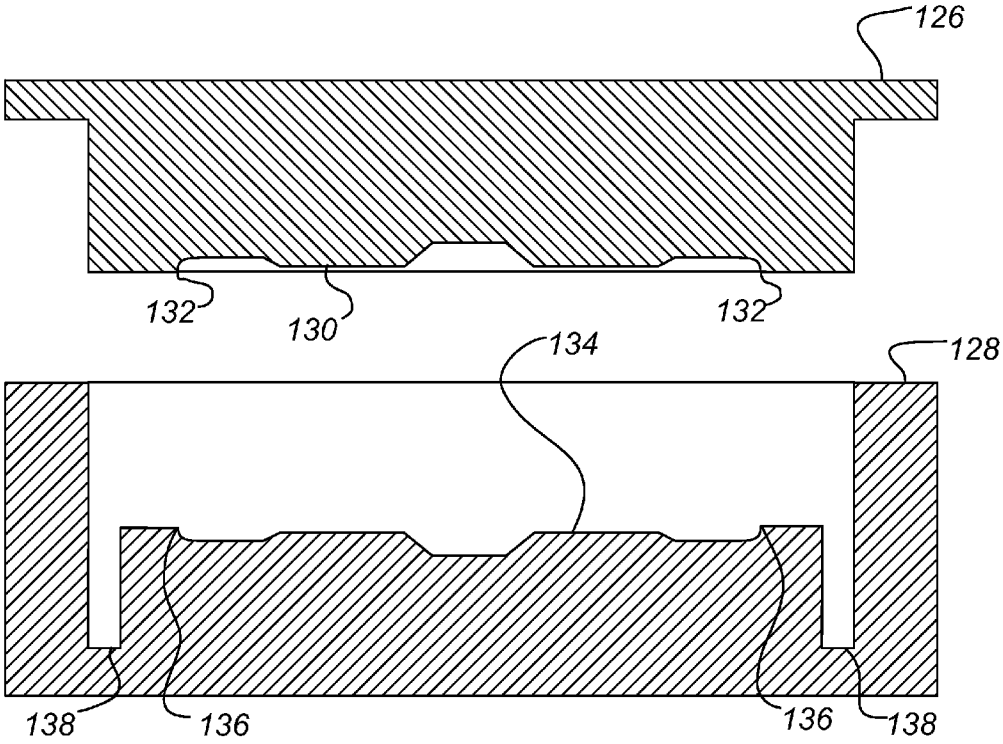
FIG. 6A illustrates a method of making the pulley assembly of FIG. 2B according to one embodiment of the invention.

Referring now to FIG. 6A, a method of producing the pulley assembly 50 is shown according to one embodiment of the invention. A first tool 126 and a second tool 128 are configured to manufacture the pulley assembly 50 and are shown in an open position. The first tool 126 includes a first tool surface 130 and a first sealing lip 132. The first tool surface 130 may define the outer surfaces of the hub portion 52 (shown in FIG. 2B and in FIG. 3B). The first sealing lip 132 may define the edges of the outer second flange portion 94 (shown in FIG. 3B). The second tool 128 includes a second tool surface 134, a second sealing lip 136, and an annular portion cavity 138. The second tool surface 134 may define the inner surfaces of the hub portion 52. The second sealing lip 136 may define the edges of the inner second flange portion 96 (shown in FIG. 3B). The annular portion cavity 138 may be of a size and shape to readily accept the insertion of the annular portion 26. The first tool 126 and the second tool 128 may be metallic.

Figure 6B:
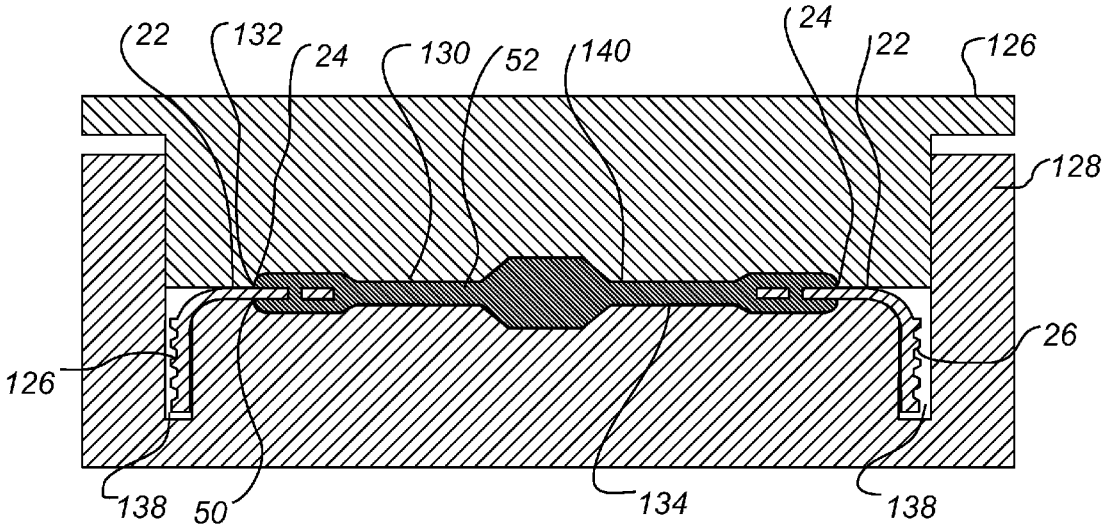
FIG. 6B illustrates a method of making the pulley assembly of FIG. 2B according to one embodiment of the invention.

As shown in FIG. 6B, the annular portion 26 is placed in the annular portion cavity 138. The first tool 126 is then placed over the second tool 128. A compressive force is applied to the first tool 126 and the second tool 128, which in turn applies a compressive force clamping the first flange portion 24 between the first sealing lip 118 and the second sealing lip 122. The sealing lips 118 and 122 may define the perimeter of a central cavity 140 that is formed between the first tool 126 and the second tool 128. A material is then introduced into the central cavity 140 to form the hub portion 52 and the second flange portion 54 extending from the hub portion 52. The material may be a molten substance, for example molten aluminum or magnesium. The material is transferred into the central cavity 140, for example injected into the central cavity 140. In another embodiment, the material is a semi-solid material and may be introduced into the central cavity 140 in accordance with the well known semi-solid forging process. The sealing lips 118 and 122 may prevent the material from leaking out of the central cavity 140. The material forms the hub portion 52 and the second flange portion 54, as shown in FIG. 6B. In one embodiment, the molten material forms hub teeth (not shown) which mechanically interlock with the complementary teeth on the first flange portion 24. In one embodiment, as the molten material comes into contact with the annular portion 26, a welding or diffusion bonding process may occur at the interface between the hub portion 52 and the annular portion 26 to further prevent relative motion therebetween. In one embodiment, the first tool 126, the second tool 128, and the annular portion 26 are maintained at a predetermined elevated temperature before the material is transferred into the central cavity 140, such that the material does not prematurely cool upon contact with a relatively cold surface. After the passing of a sufficient cooling time, the tools 126 and 128 would return to the open position as shown in FIG. 6A and the pulley assembly 50 would be removed for further processing. Further processing may include, for example, machining features into the hub portion 52 such as the central aperture 56 and the locking element 58 shown in FIG. 2B. When the tools 126 and 128 are returned to the open position, the next annular portion 26 would be inserted into the open tooling and the manufacturing process of the pulley assembly 50 would repeat.

In another embodiment (not shown), the hub portion 52 may be positioned in the first tool 126, the second tool 128 may be placed over the first tool 126, and a material may be introduced into a cavity formed between the tools 126 and 128 to form the annular portion 26.

Figure 7A:
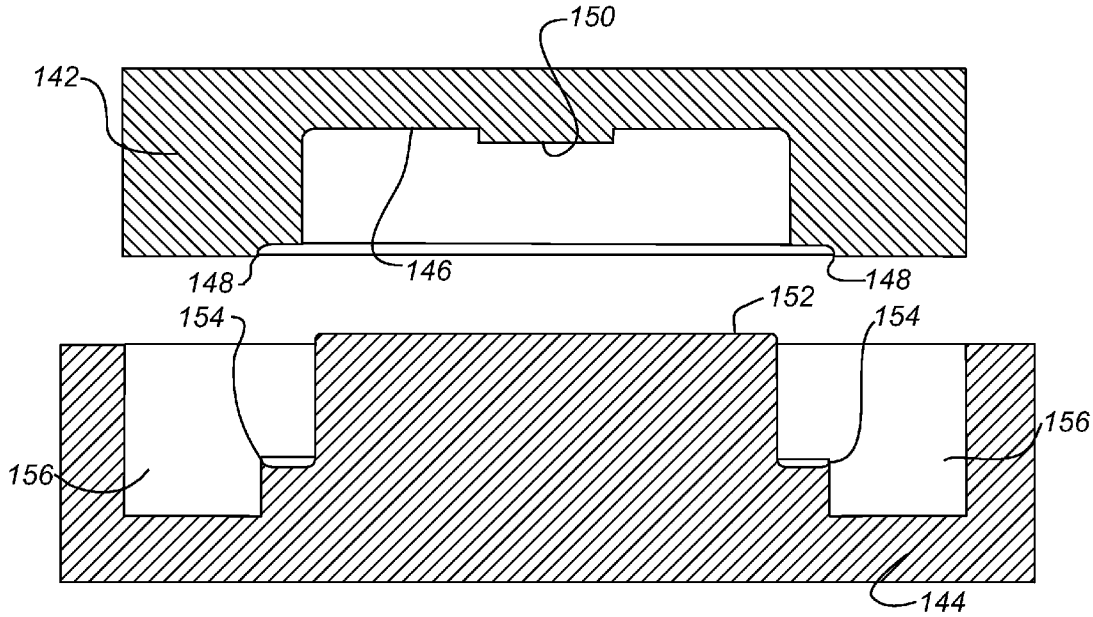
FIG. 7A illustrates a method of making the rotor assembly of FIG. 2C according to one embodiment of the invention.

Referring now to FIG. 7A, a method of producing the rotor assembly 60 is shown according to one embodiment of the invention. A first tool 142 and a second tool 144 are configured to manufacture the rotor assembly 60 and are shown in an open position. The first tool 142 includes a first tool surface 146 and a first sealing lip 148. The first tool surface 146 may define the outer surfaces of the hub portion 62 (shown in FIG. 2C and in FIG. 3E). The first sealing lip 148 may define the edges of the outer second flange portion 106 (shown in FIG. 3E). In one embodiment, the first tool 142 also includes a generally cylindrical protrusion 150 configured to produce the central aperture 72 (shown in FIG. 2C). But in other embodiments, the central aperture 72 may be produced by a subsequent machining process. In one embodiment, the plurality of bolt holes 74 (shown in FIG. 2C) may be produced by a plurality of smaller protrusions (not shown) in the first tool 142 or by a subsequent machining process.

Still referring to FIG. 7A, the second tool 144 includes a second tool surface 152, a second sealing lip 154, and an annular portion cavity 156. The second tool surface 152 may define the inner surfaces of the hub portion 62. The second sealing lip 154 may define the edges of the inner second flange portion 108 (shown in FIG. 3E). The annular portion cavity 156 may be of a size and shape to readily accept the insertion of the annular portion 32. The first tool 142 and the second tool 144 may be metallic.

Figure 7B:
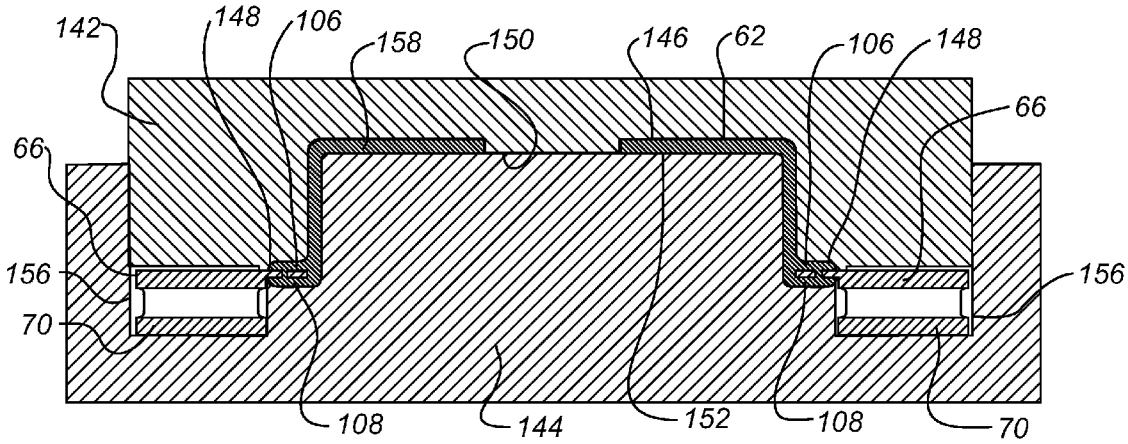
FIG. 7B illustrates a method of making the rotor assembly of FIG. 2C according to one embodiment of the invention.

As shown in FIG. 7B, the annular portion 32 is placed in the annular portion cavity 156. The first tool 142 is then placed over the second tool 144. A compressive force is applied to the first tool 142 and the second tool 144, which in turn applies a compressive force clamping the first flange portion 34 between the first sealing lip 148 and the second sealing lip 154. The sealing lips 148 and 154 may define the perimeter of a central cavity 158 that is formed between the first tool 142 and the second tool 144. A material is then introduced into the central cavity 158 to form the hub portion 62. The material may be a molten substance, for example molten aluminum or magnesium. The material is transferred into the central cavity 158, for example injected into the central cavity 158. In another embodiment, the material is a semi-solid material and may be introduced into the central cavity 156 in accordance with the well known semi-solid forging process. The sealing lips 118 and 122 may prevent the material from leaking out of the central cavity 158. The material forms the hub portion 62, as shown in FIG. 7B. In one embodiment, the molten material forms hub teeth (not shown) which mechanically interlock with the complementary teeth 36. In one embodiment, as the molten material comes into contact with the annular portion 32, a welding or diffusion bonding process may occur at the interface between the hub portion 62 and the annular portion 32 to further prevent relative motion therebetween. In one embodiment, the first tool 142, the second tool 144, and the annular portion 32 are maintained at a predetermined elevated temperature before the material is transferred into the central cavity 158, such that the material does not prematurely cool upon contact with a relatively cold surface. After the passing of a sufficient cooling time, the tools 142 and 144 would return to the open position as shown in FIG. 7A and the rotor assembly 60 would be removed for further processing. Further processing may include, for example, machining features into the hub portion 62 such as the central aperture 72 and the plurality of bolt holes 74 shown in FIG. 2C. When the tools 142 and 144 are returned to the open position, the next annular portion 32 would be inserted into the open tooling and the manufacturing process of the rotor assembly 60 would repeat.

In another embodiment (not shown), the hub portion 62 may be positioned in the first tool 142, the second tool 144 may be placed over the first tool 142, and a material may be introduced into a cavity formed between the tools 142 and 144 to form the annular portion 32.

The above description of embodiments of the invention is merely exemplary in nature and, thus, variations thereof are not to be regarded as a departure from the spirit and scope of the invention.

What is claimed is:

1. A product comprising:

an annular portion comprising a frictional surface and a first flange portion extending from the frictional surface, wherein the first flange portion comprises a first face, a second face, and a third face, and wherein the first flange portion includes a plurality of through holes located therein; and a hub portion and a second flange portion extending from the hub portion, wherein the second flange portion engages the first face, the second face, and the third face of the first flange portion.

2. A product as set forth in claim 1 wherein the annular portion comprises a first material, and the hub portion and the second flange portion comprise a second material that is lighter by volume than the first material.

3. A product as set forth in claim 2 wherein the first material comprises one of cast iron or steel.

4. A product as set forth in claim 2 wherein the second material comprises one of aluminum, magnesium, plastic, or composite material.

5. A product as set forth in claim 1 wherein the second flange portion further engages the first flange portion in the through holes of the first flange portion.

6. A product as set forth in claim 1 wherein the first flange portion further comprises a plurality of teeth and the second flange portion is configured to engage the plurality of teeth.

7. A product as set forth in claim 1 wherein the second flange portion further engages the first flange portion in the through holes of the first flange portion.

8. A product as set forth in claim 1 wherein the hub portion comprises at least one of a cylindrical bored hole, a conical bored hole, a locking element, a keyhole, a central aperture, or a plurality of holes.

9. A product as set forth in claim 1 wherein the product comprises one of a rotor, a pulley, a brake drum, a sprocket, or a transmission gear.

10. A brake rotor comprising:

an annular portion comprising a frictional surface and a first flange portion extending from the frictional surface, wherein the first flange portion comprises a first face, a second face, and a third face; and a hub portion and a second flange portion extending from the hub portion, wherein the second flange portion engages the first face, the second face, and the third face of the first flange portion, wherein the first flange portion further comprises a plurality of through holes.

* * * * *